United States Patent [19]

Stefán et al.

[11] 4,055,415

[45] Oct. 25, 1977

[54] PROCESS FOR THE REMOVAL OF ALLOYING IMPURITIES IN A SLAG-COVERED COPPER REFINING BATH

[75] Inventors: Mihály Stefán; Tibor Nagy; Sándor Daroczi, all of Budapest, Hungary

[73] Assignee: Csepeli Femmu, Budapest, Csepel, Hungary

[21] Appl. No.: 677,777

[22] Filed: Apr. 16, 1976

[30] Foreign Application Priority Data

Apr. 16, 1975 Hungary ..... CE 1040

[51] Int. Cl.[2] ..... C22B 15/00

[52] U.S. Cl. ..... 75/74; 75/76

[58] Field of Search ..... 75/74, 76

[56] References Cited

U.S. PATENT DOCUMENTS

| | | | |
|---|---|---|---|
| 1,945,074 | 1/1934 | Ralston et al. | 75/76 |
| 3,262,773 | 7/1966 | Fritze | 75/76 |
| 3,528,803 | 9/1970 | Ichikawa et al. | 75/76 |
| 3,561,952 | 2/1971 | Greenberg | 75/76 |
| 3,682,623 | 8/1972 | Dierckx et al. | 75/76 |

FOREIGN PATENT DOCUMENTS

| | | | |
|---|---|---|---|
| 1,181,921 | 11/1964 | Germany | 75/76 |

*Primary Examiner*—Walter R. Satterfield

[57] ABSTRACT

A relatively simple and rapid process for the production of high-grade copper from an inexpensive starting material such as blister copper or copper scraps is described. The starting material is conventionally smelted and oxidized, after which the charge is subjected to a slagging operation to obtain a pre-refined copper bath. After the slagging step, an artificial slag cover is formed on the pre-refined copper bath using a mixture of (1) an oxide of at least one element selected from the group consisting of silicon, phosphorous and boron, and (2) an oxide of at least one element selected from the group consisting of titanium, aluminum, calcium, strontium, barium, magnesium, sodium, potassium and lithium. At least two of such elements are then fed to the bath through the slag cover as alloying components. After such resulting bath is mixed for at least 30 seconds and is left standing for an additional 15 minutes, the slag cover is removed. A conventional reduction step may then be accomplished to complete the refining process.

12 Claims, 1 Drawing Figure

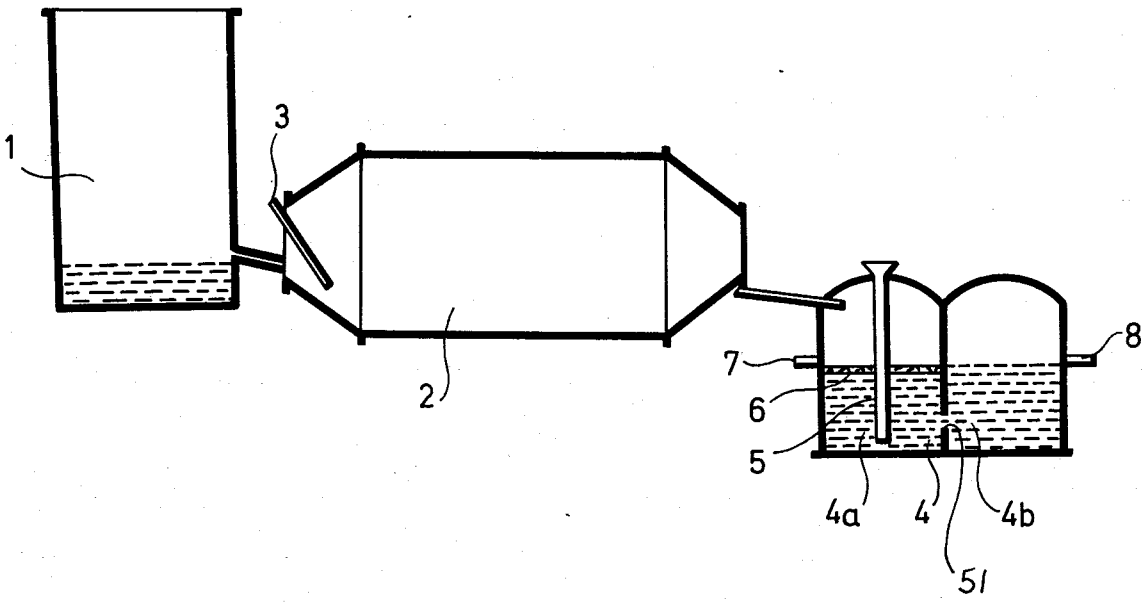
1
3
2
7
6
5
4a
4
51
4b
8

PROCESS FOR THE REMOVAL OF ALLOYING IMPURITIES IN A SLAG-COVERED COPPER REFINING BATH

BACKGROUND OF THE INVENTION

The invention relates to a process for the pyrometallurgical production of high-grade copper by smelting and oxidizing a charge of starting material, and subjecting the resultant treated charge to slagging and reducing steps to complete the refining.

Existing copper refining processes of this type, particularly when carried out on a continuous basis, have exhibited several disadvantages. In particular, they have generally been relatively slow and expensive, since it has been found difficult to obtain sufficiently pure copper on an industrial scale without subjecting the charge to multiple or repeated steps (e.g., smelting) during the process. In addition, it has been found that for separation of the impurities which accumulate on the top of the copper bath during the smelting and oxidizing steps, costly metals and chemicals have been required.

Moreover, with such prior techniques it has been possible to obtain high-grade copper only when the starting material has been of relatively high quality, e.g., high-grade copper ore.

An additional factor limiting the efficiency of refining is the fact that, with existing techniques, the relatively high dispersion of the impure oxides collected on the surface of the bath during smelting and oxidation prevents the effective separation, from the bath, of a significant portion of such impurities, whereby the unseparated impurities adhere to the lining of the smelting and oxidizing furnace. Such adhered impurities become reconverted to metal during the reduction step, thereby increasing the impurities content of the refined copper.

SUMMARY OF THE INVENTION

All of such disadvantages are overcome by the improved process in accordance with the invention for the pyrometallurgical refining of a charge of starting copper-based material into high-grade copper. Illustratively, a charge of a relatively inexpensive starting material, such as blister copper or copper scrap, is initially subjected to smelting and oxidation steps in a conventional manner. After slagging the resultant bath to obtain pre-refined copper, an artificial slag layer is deposited on top of the pre-refined bath. Such artificial slag layer is formed from a mixture of (1) an oxide of at least a first element selected from the group consisting of silicon, phosphorous and boron, and (2) an oxide of at least one second element selected from the group consisting of titanium, aluminum, calcium, strontium, barium, magnesium, sodium, potassium and lithium.

With the artificial slag layer in place, at least two refining alloying components, selected individually from the first and second groups of elements, are fed to the bottom of the pre-refined copper bath. The bath is then mixed for at least 30 seconds and preferably from 3–6 minutes, after which the bath is allowed to stand for at least 15 minutes. Then, the artificial slag layer is removed, and the reduction step accomplished in a conventional manner.

With the improved process, high-quality copper of purity as high as 99.99% can be obtained with a single electrolysis notwithstanding the use of inexpensive starting materials and inexpensive additives that make up the synthetic slag and the alloying components. In addition, the process permits considerable shortening of the time necessary for oxidation and reduction, and can be accomplished on a fully industrial scale.

BRIEF DESCRIPTION OF THE DRAWING

The invention is further set forth in the following description taken in conjunction with the appended drawing in which the single FIGURE is a representation of a pyrometallurgical apparatus for carrying out the improved process of the invention.

DESCRIPTION AND ILLUSTRATIVE EXAMPLES

The various steps of the improved process can be instrumented in the arrangement of FIG. 1 in the following way: A charge of starting material, illustratively in the form of copper scrap or blister copper having a significant degree of impurities (e.g., as high as 4–5%) is introduced into a conventional gas or oil-fired shaft furnace 1 for smelting. From the smelting furnace 1, the charge is led, illustratively on a continuous basis, into a rotary oxidizing furnace 2 of conventional construction. The oxidation is accomplished with the aid of oxygen introduced into the furnace 2 via a pipe 3 from a suitable source.

From the oxidizing furnace 2, the charge is led into a first chamber **4*a* of a double-chamber furnace 4. In the chamber 4*a***, the charge is initially slagged to define a pre-refined copper bath.

In accordance with the invention, such slagging step is followed by the formation, on the surface of the pre-refined copper bath, an artificial slag layer 6. The slag layer includes an oxide of silicon, phosphorous or boron, taken singly or in combination, and an oxide of titanium, aluminum, calcium, strontium, barium, magnesium, sodium, potassium or lithium, taken singly or in combination. Preferably, the oxides of the separate groups of elements are separately led to the surface of the pre-refined copper bath. It has been found advantageous to adjust the quantity of the slag layer 6 relative to the underlying charge so that the components of the slag layer are present in a quantity corresponding to 0.4–5.5% by weight (preferably 1.5–2% by weight) relative to the weight of the underlying charge.

With the slag layer in plce, at least two refining alloying components are introduced to the bottom of the chamber **4*a* via a graphite conduit 5. The alloying components include at least one constituent from the first group of elements whose oxides define the slag layer 6, i.e. silicon, phosphorous or boron. The second alloying component consists of an element from the second group whose oxide forms the remainder of the slag layer 6**.

The alloying components formed from the first and second groups of elements are preferably separately flowed in succession to the bottom of the chamber **4*a***, with the component having the silicon, phosphorous or boron constituent fed first. In the preferred case where the refining operation takes place on a continuous basis, such successive alloying components are flowed in succession at predetermined intervals, e.g., 5–15 minutes. Additionally, the quantity of the added alloying components should be adjusted to 4–52% by weight (e.g., 10–15%) relative to the weight of the charge.

After the addition of the alloying components, the bath is mixed in the chamber **4*a* for at least 30 seconds, and illustratively 3–6 minutes. A second slagging operation is then accomplished in which the slag layer 6 is removed in batches through an aperture 7**; advantageously, such second slagging operation is preceded by a quiescent interval of at least 15 minutes following the mixing step. Such second slagging step is effective to remove the high-dispersion impurity component which, in previous processes, adhered to the chamber walls to be re-converted to metal during a subsequent reduction step and to thereby increase the impurity of the final product.

Following the second slagging step, the pre-refined charge is introduced into a second chamber **4*b* of the furnace 4 through an aperture 51**, where a conventional reduction operation takes place to complete the refining of the charge.

Following such refining step, the refined copper is conveyed to a suitable casting mold (not shown) through a pouring gate 8.

If desired, the refining alloying components may be alloyed with pure copper before introduction to the pre-refined bath to obtain an alloy having a composition of about 90% copper.

Without in any way limiting the generality of the foregoing, the following examples are presented to illustrate representative parameters of the inventive steps.

EXAMPLE 1

13,220 kg. of copper scraps of the following composition were fed into a 15-ton revolving gas-fired drum-type furnace:

| | | | |
|---|---|---|---|
| Cu | 98.7 % | Sb | 0.05% |
| Fe | 0.4 % | Zn | 0.3 % |
| Ni | 0.01% | Sn | 0.05% |
| Pb | 0.05% | rest | 0.39% |
| As | 0.05%. | | |

300 kg of copper scale with 40 kg oxygen content were added to the batch, which was then smelted, oxidized with air to a $Cu_2O$-content of 6% by weight, and slagged. Then 60 kg of synthetic slag cover of the following composition was fed in:

| | | | |
|---|---|---|---|
| $SiO_2$ | 35% | $P_2O_5$ | 25.4% |
| CaO | 10% | $B_2O_3$ | 29.6%. |

This was followed by feeding 8.3 kg of a refining alloy having the following composition:

| | | | |
|---|---|---|---|
| Si | 33.3% | B | 33.4% |
| P | 33.3%. | | |

These refining alloying components were fed into the covered batch after alloying with 200 kg of copper. Mixing for 10 minutes was followed by slagging and reduction with wood. 12,850 kg of copper of the following composition were obtained:

| | | | |
|---|---|---|---|
| Cu | 99.86 % | Sb | 0.004% |
| Fe | 0.001% | Zn | 0.001% |
| Ni | 0.001% | Sn | 0.005% |
| Pb | 0.002% | O | 0.05 % |
| As | 0.002%. | | |

EXAMPLE 2

100 kg of impure copper blocks of the following composition were fed into a laboratory-type gas-fired reverbatory furnace:

| | | | |
|---|---|---|---|
| Cu | 97.2 % | Sb | 0.55% |
| Fe | 0.5 % | Zn | 0.4 % |
| Ni | 0.05% | Sn | 0.4 % |
| Pb | 0.25% | rest | 0.5 % |
| As | 0.15%. | | |

The copper was oxidized by adding 10 kg of $Cu_2O$. After slagging, 2 kg of a synthetic slag cover of the following composition were formed on the surface of the bath:

| | | | |
|---|---|---|---|
| $TiO_2$ | 13.0% | SrO | 5.0% |
| $P_2O_5$ | 47.8% | $K_2O$ | 2.5% |
| $B_2O_3$ | 15.2% | $Li_2O$ | 8.5% |
| MgO | 8.0%. | | |

0.5 kg of a refining additive of the following composition, closed in a copper capsule under vacuum, was fed to the bottom of the covered bath:

| | | | |
|---|---|---|---|
| Ti | 0.1 kg | Mg | 0.1 kg |
| P | 0.1 kg | K | 0.06 kg |
| B | 0.1 kg | Li | 0.04 kg. |

The bath was mixed with a graphite bar for 1 minute, then maintained at 1230° C for 20 minutes. Thereafter, slagging and reduction with ammonia gas were accomplished. 103.4 kg of refined copper of the following composition were obtained:

| | | | |
|---|---|---|---|
| Cu | 99.91 % | Sb | 0.003% |
| Fe | 0.001% | Zn | 0.002% |
| Ni | 0.004% | Sn | 0.005% |
| Pb | 0.005% | O | 0.02 % |
| As | 0.005%. | | |

EXAMPLE 3

100 kg of impure copper blocks of the following composition were fed into a laboratory-type gas-fired reverbatory furnace:

| | | | |
|---|---|---|---|
| Cu | 97.2% | Sb | 0.55% |
| Fe | 0.5% | Zn | 0.4% |
| Ni | 0.05% | Sn | 0.4% |
| Pb | 0.25% | rest | 0.5% |
| As | 0.15%. | | |

The copper was oxidized by adding 10 kg of $Cu_2O$. After slagging, 2 kg of a synthetic slag cover of the following composition were fed to the surface of the bath:

| | | | |
|---|---|---|---|
| $SiO_2$ | 20% | CaO | 10% |
| $P_2O_5$ | 15% | $K_2O$ | 15% |
| MgO | 20% | $LiO_2$ | 20%. |

0.7 kg of a refining additive of the following composition, closed in a copper capsule, was conducted to the bottom of the bath:

| | | | |
|---|---|---|---|
| Si | 0.1 kg | Ca | 0.1 kg |
| P | 0.4 kg | K | 0.1 kg |
| Mg | 0.2 kg | Li | 0.1 kg. |

The bath was mixed with a graphite bar for one minute, then maintained at a temperature of 1250° C for 15 minutes. After slagging and reduction with ammonia gas, 103.2 kg of copper of the following composition were obtained:

| | | | |
|---|---|---|---|
| Cu | 99.93% | Sb | 0.002% |
| Fe | trace | Zn | trace |
| Ni | 0.003% | Sn | 0.004% |
| Pb | 0.005% | 0 | 0.02% |
| As | 0.002%. | | |

EXAMPLE 4

13,450 kg of copper blocks of the following compositions were fed into a 15-ton revolving drum-type reverbatory furnace:

| | | | |
|---|---|---|---|
| Cu | 96.3 % | Sb | 0.05% |
| Fe | 0.5 % | Zn | 1.6 % |
| Ni | 0.2 % | Sn | 0.1 % |
| Pb | 0.2 % | Cd | 0.5 % |
| As | 0.05% | rest | 0.5%. |

The copper was smelted and oxidized with air blast to reach a $Cu_2O$-content of 7% by weight. After slagging, 200 kg of a synthetic slag cover of the following composition were introduced:

| | | | |
|---|---|---|---|
| $B_2O_3$ | 15% | $TiO_2$ | 10% |
| $SiO_2$ | 5% | SrO | 15% |
| $P_2O_5$ | 20% | MgO | 10% |
| $Al_2O_3$ | 10% | $Li_2O$ | 15%. |

Thereafter 100 kg of a refining alloy of the following composition were conducted to the bottom of the bath:

| | | | |
|---|---|---|---|
| B | 5.1% | Ti | 8.7% |
| Si | 25.2% | Sr | 5.5% |
| P | 12.3% | Mg | 22.5% |
| Al | 20.5% | Li | 0.2%. |

Mixing for 6 minutes was followed by 15 minutes of quiescence, after which slagging and reduction with wood took place. 12,500 kg of copper of the following composition were obtained:

| | | | |
|---|---|---|---|
| Cu | 99.85 % | Sb | 0.002% |
| Fe | 0.003% | Zn | 0.001% |
| Ni | 0.02 % | Sn | 0.008% |
| Pb | 0.006% | O | 0.05 %. |

EXAMPLE 5

950 kg of impure copper block of the following composition were fed into a 1-ton gas-fired tipping furnace:

| | | | |
|---|---|---|---|
| Cu | 98.0 % | As | 0.5% |
| Fe | 0.06% | Sb | 0.5% |
| Ni | 0.01% | Sn | 0.4% |
| Pb | 0.03% | rest | 0.5%. |

The batch was smelted and oxidized with an air blast to reach 10% by weight of $Cu_2O$ content. After slagging, 10 kg of a synthetic slag cover of the following composition was fed in:

| | | | |
|---|---|---|---|
| $SiO_2$ | 10% | $P_2O_5$ | 20% |
| CaO | 50% | $B_2O_3$ | 20%. |

Thereafter a refining alloy, packed in copper plate, of the following composition were introduced:

| | | | |
|---|---|---|---|
| $CaC_2$ | 3.1 kg | P | 0.53 kg |
| Si | 1.34 kg | B | 0.13 kg. |

Mixing for 10 minutes was followed by slagging and reduction with wood. 910 kg of refined copper of the following composition were obtained:

| | | | |
|---|---|---|---|
| Cu | 99.93 % | As | 0.005% |
| Fe | 0.001% | Sb | 0.01 % |
| Ni | 0.003% | Sn | 0.01 % |
| Pb | 0.001% | O | 0.04 %. |

EXAMPLE 6

100 kg of impure copper blocks of the following composition were fed into a laboratory-type gas-fired reverbatory furnace:

| | | | |
|---|---|---|---|
| Cu | 97.2 % | Sb | 0.55% |
| Fe | 0.5 % | Zn | 0.4 % |
| Ni | 0.05% | Sn | 0.4 % |
| Pb | 0.25% | rest | 0.5 % |
| As | 0.15%. | | |

The copper was reduced by adding 10 kg of $Cu_2O$ followed by slagging. Then, 1.5 kg of a synthetic slag cover of the following composition were fed in:

| | | | |
|---|---|---|---|
| $TiO_2$ | 15.8% | $SiO_2$ | 25 % |
| BaO | 20.2% | $Li_2O$ | 7.5% |
| $Na_2O$ | 31.5%. | | |

0.3 kg of a refining alloy of the following composition closed under vacuum in a copper capsule were then conducted to the bottom of the bath:

| | | | |
|---|---|---|---|
| Ti | 0.1 kg | Na | 0.15 kg |
| Ca | 0.05 kg. | | |

The bath was mixed with a graphite bar for one-half minute, then kept at a temperature of 1210° C for 15 minutes.

After slagging and reduction with ammonia gas, 103.5 kg of copper of the following composition were obtained:

| | | | |
|---|---|---|---|
| Cu | 99.85 % | Sb | 0.003% |
| Fe | 0.002% | Zn | 0.001% |
| Ni | 0.006% | Sn | 0.007% |
| Pb | 0.005% | O | 0.03 % |
| As | 0.004%. | | |

EXAMPLE 7

100 kg of impure copper blocks of the following composition were fed into a laboratory-type gas-fired reverbatory furnace:

| | | | |
|---|---|---|---|
| Cu | 98.9 % | Sb | 0.05% |
| Fe | 0.3 % | Zn | 0.3 % |
| Ni | 0.02% | Sn | 0.05% |
| Pb | 0.06% | rest | 0.3 % |
| As | 0.02%. | | |

The copper was oxidized by adding 1.7 kg of $Cu_2O$. After slagging, 0.5 kg of a synthetic slag cover of the following composition was fed in:

| | | | |
|---|---|---|---|
| $P_2O_5$ | 75% | $TiO_2$ | 25%. |

0.15 kg of a refining additive of the following composition, closed in a copper capsule, were then conducted to the bottom of the bath:

| | | | |
|---|---|---|---|
| P | 60% | Ti | 40%. |

The bath was mixed with a garphite bar for 30 seconds, then left to rest for 15 minutes. After slagging, the bath was reduced with ammonia gas. 104.6 kg of copper of the following composition were obtained:

| | | | |
|---|---|---|---|
| Cu | 99.87 % | Zn | 0.001% |
| Fe | 0.001% | Sn | 0.002% |
| Ni | 0.001% | O | 0.03 % |
| Pb | 0.002%. | | |

EXAMPLE 8

100 kg of impure copper blocks of the following composition were fed into a laboratory-type gas-fired reverbatory furnace:

| | | | |
|---|---|---|---|
| Cu | 98.9 % | Sb | 0.05% |
| Fe | 0.3 % | Zn | 0.3 % |
| Ni | 0.02% | Sn | 0.05% |
| Pb | 0.06% | rest | 0.3 % |
| As | 0.02%. | | |

The copper was oxidized by adding 7 kg of $Cu_2O$. After slagging, 0.5 kg of a synthetic slag cover of the following composition was added:

| | | | |
|---|---|---|---|
| $SiO_2$ | 50% | $Na_2O$ | 50%. |

0.15 kg of a refining additive of the following composition, closed under vacuum in a copper capsule, was conducted to the bottom of the bath:

| | | | |
|---|---|---|---|
| Si | 55% | Al | 45%. |

The bath was mixed with a graphite bar for one-half minute, then left to rest for 15 minutes. After slagging and reduction with ammonia gas, 104.3 kg of copper of the following composition were obtained:

| | | | |
|---|---|---|---|
| Cu | 99.86 % | Sb | 0.002% |

-continued

| | | | |
|---|---|---|---|
| Fe | 0.001% | Zn | 0.001% |
| Ni | 0.001% | Sn | 0.002% |
| Pb | 0.002% | O | 0.04 % |
| As | 0.001%. | | |

EXAMPLE 9

100 kg of impure copper blocks of the following composition were fed into a laboratory-type gas-fired reverbatory furnace:

| | | | |
|---|---|---|---|
| Cu | 98.9 % | Sb | 0.05% |
| Fe | 0.3 % | Zn | 0.3 % |
| Ni | 0.02% | Sn | 0.05% |
| Pb | 0.06% | rest | 0.3 % |
| As | 0.02%. | | |

The copper was oxidized by adding 10 kg of $Cu_2O$. After slagging, 0.5 kg of a synthetic slag cover of the following composition were fed in:

| | | | |
|---|---|---|---|
| $B_2O_3$ | 55% | CaO | 45%. |

Thereafter, 0.5 kg of a refining additive of the following composition was conducted to the bottom of the bath:

| | | | |
|---|---|---|---|
| B | 40% | CaO | 45%. |

Thereafter, the bath was mixed with a graphite bar for one-half minute, then left to rest for 15 minutes. After slagging, the bath was reduced with ammonia gas. 104.1 kg of copper of the following composition were obtained:

| | | | |
|---|---|---|---|
| Cu | 99.88 % | Sb | 0.001% |
| Fe | 0.001% | Zn | trace |
| Ni | 0.001% | Sn | trace |
| Pb | 0.001% | O | 0.05 % |
| As | 0.001%. | | |

EXAMPLE 10

14,200 kg of impure copper blocks of the following composition were fed into a 15-ton revolving drum-type gas-fired reverbatory furnace:

| | | | |
|---|---|---|---|
| Cu | 97.5 % | Sb | 0.01% |
| Fe | 0.5 % | Zn | 0.8 % |
| Ni | 0.3 % | Sn | 0.1 % |
| Pb | 0.05% | Cd | 0.1 % |
| As | 0.01% | rest | 0.63%. |

The copper was melted and oxidized to reach a $Cu_2O$-content of 6.5% by weight. After slagging, 150 kg of a synthetic slag cover of the following composition were fed in:

| | | | |
|---|---|---|---|
| $SiO_2$ | 30% | $B_2O_3$ | 20% |
| $Na_2O$ | 30% | $Al_2O_3$ | 20%. |

Thereafter 150 kg of an AlSi-alloy of the following composition were conducted to the bottom of the bath:

| | | | |
|---|---|---|---|
| Al | 65% | Si | 35%. |

Following mixing for 3 minutes, the bath was left to rest for 20 minutes, then slagged and reduced with wood. 13,300 kg refined copper of the following composition were obtained:

| | | | |
|---|---|---|---|
| Cu | 99.88 % | Sb | 0.002% |
| Fe | 0.002% | Zn | 0.001% |
| Ni | 0.01 % | Cd | 0.001% |
| Pb | 0.005% | Sn | 0.002% |
| As | 0.005%. | | |

EXAMPLE 11

13,500 kg of copper blocks of the following composition were fed into a 15-ton revolving drum-type gas-fired furnace:

| | | | |
|---|---|---|---|
| Cu | 97.2% | Sb | 0.1% |
| Fe | 0.4% | Zn | 1.3% |
| Ni | 0.1% | Sn | 0.1% |
| Pb | 0.1% | Cd | 0.4% |
| As | 0.05% | rest | 0.25%. |

The copper was smelted, then oxidized with an air blast to reach a $Cu_2O$-content of 6.8% by weight. After slagging, 160 kg of a synthetic slag cover of the following composition were fed in:

| | | | |
|---|---|---|---|
| $SiO_2$ | 50% | $Na_2O$ | 50%. |

After this, the following refining alloying components were fed to the bottom of the bath:

| | | | |
|---|---|---|---|
| Si | 20 kg | $CaC_2$ | 20 kg |
| Li | 10 kg. | | |

The lithium component was placed under vacuum into a copper capsule before feed-in.

By rotating the furnace, mixing was carried out for 5 minutes, followed by quiescence for 15 minutes. After slagging and reduction with wood, 12,700 kg of copper of the following composition were obtained:

| | | | |
|---|---|---|---|
| Cu | 99.97 % | Sb | 0.005% |
| Fe | 0.001% | Zn | 0.001% |
| Ni | 0.002% | Sn | 0.001% |
| Pb | 0.005% | O | 0.02 % |
| As | 0.001%. | | |

EXAMPLE 12

Converter copper of the following composition was smelted in a shaft furnace at the rate of 1 ton/hour:

| | | | |
|---|---|---|---|
| Cu | 99.1 % | Sb | 0.1 % |
| Fe | 0.05% | Zn | 0.05% |
| Ni | 0.07% | Sn | 0.1 % |
| Pb | 0.1 % | rest | 0.38% |
| As | 0.05%. | | |

The smelted copper was flowed through a channel into a 1-ton revolving-type furnace, in which 5% by weight $Cu_2O$-content was continuously attained via an air blast. From here, the copper was flowed at a continuous rate to a double-chamber furnace into the first chamber of which 10 kg of a synthetic slag cover of the following composition was fed in:

| | | | |
|---|---|---|---|
| $SiO_2$ | 45% | $P_2O_5$ | 25% |
| CaO | 10% | $B_2O_3$ | 20%. |

The slag cover was removed after 1 hour. An additional 10 kg of synthetic slag cover of identical composition was then fed onto the top of the bath. A refining alloy, in 0.5 kg batches each of the following composition, was then fed at 15-minute intervals to the bottom of the copper bath in the first chamber of the double-chamber furnace:

| | | | |
|---|---|---|---|
| Si | 27.5% | Al | 30% |
| P | 17.5% | Ca | 20% |
| B | 5 %. | | |

After mixing and slagging, reduction was carried out in the second chamber of the double-chamber furnace with cracked ammonia. The so-obtained copper was of the following composition:

| | | | |
|---|---|---|---|
| Cu | 99.88 % | As | 0.001% |
| Fe | 0.01 % | Sb | 0.002% |
| Ni | 0.005% | Zn | 0.002% |
| Pb | 0.001% | O | 0.03 %. |

EXAMPLE 13

Scrap copper of the following composition was continuously smelted in a shaft furnace at the rate of 4 tons/hour:

| | | | |
|---|---|---|---|
| Cu | 98.8 % | Sb | 0.15% |
| Fe | 0.2 % | Zn | 0.3 % |
| Ni | 0.01% | Sn | 0.05% |
| Pb | 0.1 % | rest | 0.38% |
| As | 0.01%. | | |

The smelted copper was flowed into the furnace according to Example 12, in which it was oxidized until reaching a $Cu_2O$-content of 6% by weight. From here, the copper was flowed at a continuous rate to a double-chamber furnace, into the first chamber of which a synthetic slag cover of the following composition was fed at the rate of 50 kg/hour:

| | | | |
|---|---|---|---|
| $SiO_2$ | 45% | $P_2O_5$ | 25% |
| CaO | 10% | $B_2O_3$ | 20%. |

The slag was removed every hour. Alloying components formed from the following materials were successively conducted to the bottom of the bath at repetitive 5-minute intervals: (1) 0.5 kg of silicon; (2) 0.5 kg of phosphorous; (3) 0.5 kg of boron; and (4) 0.5 kg of calcium carbide. A total of 6 kg of refining alloying components were conducted to the bath every hour. Reduction was carried out in the second chamber of the furnace with natural gas. The obtained copper was of the following composition:

| | | | |
|---|---|---|---|
| Cu | 99.92 % | Sb | 0.002% |
| Fe | 0.01 % | Zn | 0.001% |
| Si | 0.02 % | Sn | 0.002% |

-continued

| | | | |
|---|---|---|---|
| Pb | 0.01 % | O | 0.04 % |
| As | 0.001%. | | |

EXAMPLE 14

Copper blocks of the following composition were continuously smelted in a shaft furnace at the rate of 4 tons/hour:

| | | | |
|---|---|---|---|
| Cu | 98.1 % | Sb | 0.25% |
| Fe | 0.4 % | Zn | 0.5 % |
| Ni | 0.01% | Sn | 0.05% |
| Pb | 0.2 % | rest | 0.39% |
| As | 0.1 %. | | |

The smelted copper was flowed through a channel into a 12-ton revolving drum-type furnace, wherein 6% by weight of $Cu_2O$-content was obtained by continuous oxidation with an air blast. From here, the copper was flowed at a continuous rate to a double-chamber furnace into the first chamber of which 70 kg of a synthetic slag cover of the following composition were fed in:

| | | | |
|---|---|---|---|
| $SiO_2$ | 25% | $TiO_2$ | 10% |
| $B_2O_2$ | 20% | $Na_2O$ | 15% |
| BaO | 15% | $Li_2O$ | 5% |
| SrO | 10%. | | |

The slag was changed every hour. The following elements, closed in a copper capsule, were successively fed to the bottom of the copper bath at repetitive 5-minute intervals in the first chamber of the double-chamber furnace: (1) 0.8 kg of silicon; (2) 1.1 kg of boron; (3) 0.5 kg of barium and strontium; (4) 0.4 kg titanium; (5) 1 kg of sodium; and (6) 0.2 kg of lithium. A total of 8 kg of refining alloying components were fed in per hour.

Reduction with cracked ammonia was carried out in the second chamber of the double-chamber furnace. The obtained copper was of the following composition:

| | | | |
|---|---|---|---|
| Cu | 99.92 % | As | 0.001% |
| Fe | 0.005% | Sb | 0.002% |
| Ni | 0.002% | Zn | 0.002% |
| Pb | 0.001% | O | 0.04 %. |

EXAMPLE 15

Copper blocks of the following composition were continuously smelted in a shaft furnace at the rate of 4 tons/hour:

| | | | |
|---|---|---|---|
| Cu | 99.1 % | Sb | 0.05% |
| Fe | 0.2 % | Zn | 0.01% |
| Ni | 0.01% | Sn | 0.02% |
| Pb | 0.1 % | rest | 0.46% |
| As | 0.05%. | | |

The smelted copper was flowed through a channel into a 12-ton revolving drum-type furnace, in which oxidation with an air blast at a continuous rate resulted in a $Cu_2O$-content of 5% by weight. From here, the copper was flowed at a continuous rate to a double-chamber furnace, into the first chamber of which a synthetic slag cover of the following composition was fed at a rate of 60 kg/hour:

| | | | |
|---|---|---|---|
| $B_2O_3$ | 55% | $Li_2O$ | 45%. |

The slag was changed every hour. In the first chamber of the double-chamber furnace, the following elements (in a copper capsule) were successively fed to the bottom of the copper bath at repetitive 15-minute intervals: (1) 1.2 kg of boron; and (2) 0.8 kg of lithium. Such refining alloying components were fed into the bath at a rate of 4 kg/hour. In the second chamber of the double-chamber furnace, reduction was carried out with cracked ammonia. The obtained copper was of the following composition:

| | | | |
|---|---|---|---|
| Cu | 99.95 % | Sb | 0.001% |
| Fe | trace | Zn | trace |
| Ni | 0.001% | Sn | trace |
| Pb | 0.001% | O | 0.02 % |
| As | 0.001%. | | |

EXAMPLE 16

14,850 kg of copper scraps of the following composition were fed into a 15-ton revolving drum-type furnace:

| | | | |
|---|---|---|---|
| Cu | 95.2% | Sb | 0.2% |
| Fe | 0.6% | Zn | 0.5% |
| Ni | 0.3% | Sn | 0.6% |
| Pb | 0.8% | Cd | 0.1% |
| As | 0.3% | rest | 1.4%. |

The copper was smelted by gas firing, oxidized by an air blast to reach 7% by weight of $Cu_2O$-content, and then slagged. Thereafter 100 kg of synthetic slag cover of the following composition was fed in:

| | | | |
|---|---|---|---|
| $SiO_2$ | 45.3% | $P_2O_5$ | 39% |
| CaO | 6 % | $B_2O_3$ | 9.7%. |

After this, 100 kg of refining alloying components of the following composition were conducted to the bottom of the bath:

| | | | |
|---|---|---|---|
| Si | 33.3% | B | 33.4% |
| P | 33.3%. | | |

The bath was then mixed for 10 minutes, followed by slagging. Then, 50 kg of synthetic slag cover of the following composition were fed to the bath:

| | | | |
|---|---|---|---|
| CaO | 71.4% | $P_2O_5$ | 15.1% |
| $SiO_2$ | 10.5% | $B_2O_3$ | 3 %. |

After this, a further 48.5 kg of refining alloy of the following elements were fed to the bottom of the bath after being smelted with pure copper so that an alloy is obtained containing 90% of copper and 10% of the following refining alloying components:

| | | | |
|---|---|---|---|
| Al | 97.5% | P | 1 % |
| Si | 1 % | B | 0.5%. |

The bath was then mixed for 10 minutes, followed by slagging and reduction with wood. 13,900 kg of copper of the following composition were obtained:

| | | | |
|---|---|---|---|
| Cu | 99.85 % | Sb | 0.002% |
| Fe | 0.005% | Zn | 0.002% |
| Ni | 0.03 % | Sn | 0.006% |
| Pb | 0.008% | O | 0.06 % |
| As | 0.006%. | | |

EXAMPLE 17

12,380 kg of copper scraps of the following composition are fed into the furnace of Example 16:

| | | | |
|---|---|---|---|
| Cu | 97.6 % | Sb | 0.5% |
| Fe | 0.3 % | Zn | 0.5% |
| Ni | 0.05% | Sn | 0.4% |
| Pb | 0.15% | rest | 0.4% |
| As | 0.1 %. | | |

1,500 kg of oxidized cement copper with 62 kg oxygen content were then added to the batch, and the charge was smelted and oxidized until a $Cu_2O$-content of 7% by weight was reached. After slagging, 70 kg of a synthetic slag cover of the following composition were fed in:

| | | | |
|---|---|---|---|
| $SiO_2$ | 28.5% | $P_2O_5$ | 31.5% |
| CaO | 20 % | $B_2O_3$ | 20 %. |

Thereafter, 300 kg of a copper alloy containing 30 kg of refining alloying components with the following composition were conducted to the bottom of the tank:

| | | | |
|---|---|---|---|
| Si | 66.8% | B | 6.6% |
| P | 26.6%. | | |

The bath was mixed for 10 minutes and slagged. Then, a further 40 kg of slag cover of the following composition were fed to the bath:

| | | | |
|---|---|---|---|
| $Al_2O_3$ | 25% | $P_2O_5$ | 21% |
| CaO | 25% | $B_2O_3$ | 14% |
| $SiO_2$ | 15%. | | |

After this, 36 kg of a refining alloy of the following composition were fed to the bottom of the bath:

| | | | |
|---|---|---|---|
| Ca | 5% | P | 30% |
| Al | 45% | B | 5% |
| Si | 15%. | | |

The bath was mixed for 10 minutes, followed by slagging and reduction with wood. 13,500 kg of copper of the following composition were obtained:

| | | | |
|---|---|---|---|
| Cu | 99.88 % | Sb | 0.002% |
| Fe | 0.001% | Zn | 0.001% |
| Ni | 0.005% | Sn | 0.005% |
| Pb | 0.003% | O | 0.04 % |
| As | 0.005%. | | |

EXAMPLE 18

Copper blocks of the following composition were continuously smelted in a shaft furnace at the rate of 4 tons/hour:

| | | | |
|---|---|---|---|
| Cu | 98.1 % | Sb | 0.25% |
| Fe | 0.4 % | Zn | 0.5 % |
| Ni | 0.01% | Sn | 0.05% |
| Pb | 0.2 % | rest | 0.39% |
| As | 0.1 %. | | |

The smelted copper was flowed through a channel into a 12-ton revolving drum-type furnace, in which a $Cu_2O$-content of 7% by weight was attained at a continuous rate by oxidizing with air. From here, the copper was flowed at a continuous rate to a double-chamber furnace, into the first chamber of which a synthetic slag cover of the following composition was fed at the rate of 70 kg/hour:

| | | | |
|---|---|---|---|
| $B_2O_3$ | 25% | BaO | 10% |
| $P_2O_5$. | 35% | $Na_2O$ | 30%. |

The slag was changed every hour. The following refining elements were successively fed to the bottom of the bath at repetitive 10-minute intervals: (1) 1.5 kg of phosphorous; (2) 1.2 kg of aluminum; and (3) 1.3 kg of calcium, in the form of calcium carbide. A total amount of 8 kg of refining elements were fed in per hour. Reduction was carried out in the second chamber of the furnace with natural gas. The obtained copper was of the following composition:

| | | | |
|---|---|---|---|
| Cu | 99.87 % | Sb | 0.002% |
| Fe | trace | Zn | trace |
| Ni | 0.001% | Sn | 0.001% |
| Pb | 0.001% | O | 0.04 % |
| As | 0.001%. | | |

EXAMPLE 19

Copper blocks of the following composition were continuously smelted in a shaft furnace at a rate of 4 tons/hour:

| | | | |
|---|---|---|---|
| Cu | 98.5% | Sb | 0.2 % |
| Fe | 0.3% | Zn | 0.5 % |
| Ni | 0.1% | Sn | 0.01% |
| Pb | 0.1% | rest | 0.19% |
| As | 0.1%. | | |

The smelted copper was flowed into a 12-ton revolving drum-type furnace, in which an oxygen-content of 0.7% by weight was continuously attained by oxidation with air. From here, the copper was flowed at a continuous rate to a double-chamber furnace, into the first chamber of which a synthetic slag cover of the following composition was fed at a rate of 70 kg/hour:

| | | | |
|---|---|---|---|
| $SiO_2$ | 25% | $P_2O_5$ | 35% |
| $Li_2O$ | 40%. | | |

The slag was changed every hour. The following elements were conducted successively to the bottom of the bath at repetitive 7.5-minute intervals: (1) 0.5 kg of silicon; (2) 1.2 kg of sodium; (3) 1.1 kg of phosphorous;

and (4) 0.5 kg of lithium. The lithium and sodium had been enclosed in separate copper capsules under vacuum. A total of 6.6 kg of refining elements were fed in every hour. The composition of the copper obtained after subsequent reduction was as follows:

| | | | |
|---|---|---|---|
| Cu | 99.88 % | Sb | 0.002% |
| Fe | 0.002% | Zn | trace |
| Ni | 0.001% | Sn | 0.001% |
| Pb | 0.002% | O | 0.03 % |
| As | 0.001%. | | |

EXAMPLE 20

14,500 kg of copper scraps of the following composition were fed into a 15-ton, gas-fired revolving drum-type furnace:

| | | | |
|---|---|---|---|
| Cu | 95.1% | Sb | 0.2% |
| Fe | 0.8% | Zn | 0.6% |
| Ni | 0.2% | Sn | 1.0% |
| Pb | 0.9% | Cd | 0.3% |
| As | 0.2% | rest | 0.7%. |

The copper was smelted and then oxidized with an air blast until a $Cu_2O$-content of 7% by weight was reached. After slagging, 150 kg of a synthetic slag cover of the following composition were fed in:

| | | | |
|---|---|---|---|
| $SiO_2$ | 45.3% | $P_2O_5$ | 39.0% |
| CaO | 6 % | $B_2O_3$ | 9.7%. |

After this, 220 kg of a refining additive of the following composition were conducted to the bottom of the bath:

| | | | |
|---|---|---|---|
| Si | 33.3% | B | 33.4% |
| P | 33.3%. | | |

The bath was mixed for 10 minutes, followed by slagging. Then, 80 kg of a synthetic slag cover of the following composition were fed onto the bath:

| | | | |
|---|---|---|---|
| CaO | 71.4% | $P_2O_5$ | 15.1% |
| $SiO_2$ | 10.5% | $B_2O_3$ | 3.0%. |

Thereafter, a further 130 kg of a refining alloy which had previously been smelted with pure copper so that the copper content of the obtained alloy amounted to 90% and the following refining alloy content to 10%, were fed to the bottom of the bath:

| | | | |
|---|---|---|---|
| Al | 97.5% | P | 1.0% |
| Si | 1.0% | B | 0.5%. |

The bath was mixed for 10 minutes, followed by slagging and by reduction with wood. 13,885 kg of copper of the following composition were obtained:

| | | | |
|---|---|---|---|
| Cu | 99.86 % | Sb | 0.002% |
| Fe | 0.005% | Zn | 0.002% |
| Ni | 0.04 % | Sn | 0.006% |
| Pb | 0.008% | O | 0.05 % |
| As | 0.006%. | | |

EXAMPLE 21

14,500 kg of copper scraps of the following composition are fed into a gas-fired 15-ton revolving drum-type furnace:

| | | | |
|---|---|---|---|
| Cu | 95.4% | Sb | 0.3% |
| Fe | 0.7% | Zn | 0.8% |
| Ni | 0.2% | Sn | 0.8% |
| Pb | 0.8% | Cd | 0.1% |
| As | 0.2% | rest | 0.7%. |

The copper was smelted and then oxidized with an air blast until a $Cu_2O$-content of 7% by weight was reached. After slagging, 500 kg of a synthetic slag cover of the following composition were fed in:

| | | | |
|---|---|---|---|
| $SiO_2$ | 45.3% | $P_2O_5$ | 39.0% |
| CaO | 6.0% | $B_2O_3$ | 9.7%. |

Thereafter, 100 kg of a refined additive of the following composition were conducted to the bottom of the bath:

| | | | |
|---|---|---|---|
| Si | 33.3% | B | 33.4% |
| P | 33.3%. | | |

The bath was mixed for 10 minutes, followed by slagging. Then, 220 kg of a synthetic slag cover of the following composition were fed onto the bath:

| | | | |
|---|---|---|---|
| CaO | 71.4% | $P_2O_5$ | 15.1% |
| $SiO_2$ | 10.5% | $B_2O_3$ | 3.0%. |

After this, 56 kg of a refining alloy, which had previously been smelted with pure copper so that the copper content of the obtained alloy amounted to 90% and the following refining alloy content to 10%, were fed to the bottom of the bath:

| | | | |
|---|---|---|---|
| Al | 97.5% | P | 1.0% |
| Si | 1.0 % | B | 0.5%. |

The bath was then mixed for 10 minutes followed by slagging and by reduction with wood. 13,080 kg of copper of the following composition were obtained:

| | | | |
|---|---|---|---|
| Cu | 99.86 % | Sb | 0.002% |
| Fe | 0.005% | Zn | 0.002% |
| Ni | 0.03 % | Sn | 0.006% |
| Pb | 0.007% | O | 0.06 % |
| As | 0.005%. | | |

EXAMPLE 22

15,000 kg of copper scraps of the following composition were fed into a 15-ton revolving drum-type gas-fired furnace:

| | | | |
|---|---|---|---|
| Cu | 94.8% | Sb | 0.3% |
| Fe | 0.9% | Zn | 1.0% |
| Ni | 0.3% | Sn | 1.0% |
| Pb | 0.7% | Cd | 0.1% |

-continued

| | | | |
|---|---|---|---|
| As | 0.2% | rest | 0.7%. |

The copper was smelted and then oxidized with an air blast until a $Cu_2O$-content of 7% by weight was reached. After slagging, 520 kg of a synthetic slag cover of the following composition were fed in:

| | | | |
|---|---|---|---|
| $SiO_2$ | 45.3% | $P_2O_5$ | 39.0% |
| CaO | 6.0% | $B_2O_3$ | 9.7%. |

Thereafter, 250 kg of a refining additive of the following composition were conducted to the bottom of the bath:

| | | | |
|---|---|---|---|
| Si | 33.3% | B | 33.4% |
| P | 33.3%. | | |

The bath was mixed for 10 minutes, followed by slagging. Then 230 kg of a synthetic slag cover of the following composition were fed to the bath:

| | | | |
|---|---|---|---|
| CaO | 71.4% | $P_2O_5$ | 15.1% |
| $SiO_2$ | 10.5% | $B_2O_3$ | 3.0%. |

After this, a further 130 kg of a refining alloy, which had previously been smelted with pure copper so that the copper content of the obtained alloy amounted to 90% and the following refining alloy content to 10%, were fed to the bottom of the bath:

| | | | |
|---|---|---|---|
| Al | 97.5% | P | 1.0% |
| Si | 1.0% | B | 0.5%. |

The bath was mixed for 10 minutes, followed by slagging and by reduction with wood. 13,950 kg of copper of the following composition were obtained:

| | | | |
|---|---|---|---|
| Cu | 99.84 % | Sb | 0.002% |
| Fe | 0.004% | Zn | 0.001% |
| Ni | 0.03% | Sn | 0.006% |
| Pb | 0.007% | O | 0.05% |
| As | 0.006%. | | |

In the foregoing, some illustrative examples of the claimed process have been described. Many variations and modifications will now occur to those skilled in the art. It is accordingly desired that the scope of the appended claims not be limited to the specific disclosure herein contained.

What is claimed is:

1. In a process for the pyrometallurgical production of high-grade copper from a starting material selected from the group consisting of blister copper and copper scraps, the process comprising the successive steps of smelting and oxidizing a charge of the starting material, slagging the smelted and oxidized charge to obtain a pre-refined copper bath, and reducing the pre-refined copper bath to complete the refining, the improvement which comprises the further steps, accomplished between the slagging and reduction steps, of forming seconds the pre-refined copper bath an artificial slag cover consisting of a mixture of an oxide of at least one first element selected from the group consisting of silicon, phosphorous and boron and an oxide of at least one second element selected from the group consisting of titanium, aluminum, calcium, strontium, barium, magnesium, sodium, potassium and lithium, contacting the resulting covered bath with at least two elements selected from the group consisting of silicon, phosphorous, boron, titanium, aluminum, calcium, strontium, barium, magnesium, sodium, potassium and lithium, mixing the resulting bath for a first interval of at least 30 seconds, duration, maintaining the mixed bath in a rest condition for at least an additional 15 minutes, and then removing the artificial slag cover.

2. A process as defined in claim 1, in which the first interval of the mixing step is in the range of 3–6 minutes.

3. A process as defined in claim 1, in which the contacting step is accomplished by flowing the first and second elements in succession into the pre-refined copper bath.

4. A process as defined in claim 3, in which the smelting, oxidizing, slagging and reducing steps are accomplished on a continuous basis, and in which the step of flowing the first and second elements in succession into the pre-refined copper bath is repeated at regular second intervals.

5. A process as defined in claim 4, in which the second intervals are in the range of 5–15 minutes.

6. A process as defined in claim 1, in which the quantity of elements contacting the pre-refined copper bath amounts to 4–52% by weight relative to the amount of charge.

7. A process as defined in claim 6, in which the amount of elements amounts to 10–15% by weight relative to the amount of charge.

8. A process as defined in claim 7, in which the contacting step is accomplished by allowing the elements with copper, and then feeding the resulting copper alloy to the bath.

9. A process as defined in claim 1, in which the forming step is accomplished by separately depositing the oxides of the first and second elements on the top of the pre-refined copper bath.

10. A process as defined in claim 1, in which the quantity of slag cover formed on the top of the pre-refined copper bath amounts to 0.4–5.5% by weight relative to the weight of the charge.

11. A process as defined in claim 10, in which the quantity of the slag cover amounts to 1.5–2% by weight of the charge.

12. A process as defined in claim 1, in which the contacting step is accomplished by feeding the elements to the bottom of the bath.

* * * * *